United States Patent [19]

Gerbrandt

[11] Patent Number: 4,852,279

[45] Date of Patent: Aug. 1, 1989

[54] DIGGING IMPLEMENT OR BLADE THEREFOR

[75] Inventor: George Gerbrandt, Winnipeg, Canada

[73] Assignee: Met-Line Inc., Otterburne, Canada

[21] Appl. No.: 233,020

[22] Filed: Aug. 17, 1988

[30] Foreign Application Priority Data

Aug. 18, 1987 [GB] United Kingdom ..... 8719487

[51] Int. Cl.[4] ..... E01H 5/09

[52] U.S. Cl. ..... 37/252; 198/676

[58] Field of Search ..... 37/209–213, 37/252, 254, 255, 257, 249, 242, 243; 198/670, 671, 676, 677, 657

[56] References Cited

U.S. PATENT DOCUMENTS

| | | | |
|---|---|---|---|
| 2,769,255 | 11/1956 | Mead . | |
| 2,787,064 | 4/1957 | Schiller . | |
| 3,073,100 | 1/1963 | Kingsley | 37/243 |
| 3,253,356 | 5/1966 | Haban . | |
| 3,484,963 | 12/1969 | Heth et al. . | |
| 4,123,857 | 11/1978 | Enters et al. . | |
| 4,150,501 | 4/1979 | Hayashi . | |
| 4,322,896 | 4/1982 | Miyazawa et al. . | |

FOREIGN PATENT DOCUMENTS

| | | | |
|---|---|---|---|
| 950483 | 7/1974 | Canada . | |
| 1154039 | 9/1983 | Canada . | |
| 1196348 | 11/1985 | Canada . | |
| 1133415 | 7/1962 | Fed. Rep. of Germany | 37/257 |

*Primary Examiner*—Eugene H. Eickholt

*Attorney, Agent, or Firm*—Murray E. Thrift; Stanley G. Ade; Adrian D. Battison

[57] ABSTRACT

A blade is provided for a digging implement, especially a snowthrower. The implement is of the type having an auger blade arranged for advancement sideways into a body of material to be removed. The blade consists of a band with a leading edge wound along a blade axis, preferably helically, and a tapered body that slopes towards the axis away from the material discharge of the device. In the case of a snowthrower, where the material discharge is at the center, the blade will have two sections, wound oppositely around the blade axis and tapering in opposite directions towards the axis, away from the center discharge. The blade performs a slicing action on the material to be removed rather than scraping material from its face as is the case with the conventional snowthrower and analogous implements. The blade is thus aggressive and draws itself into the material, reducing the power requirements of both the blade and the system for propelling it into the material.

19 Claims, 2 Drawing Sheets

DIGGING IMPLEMENT OR BLADE THEREFOR

FIELD OF THE INVENTION

The present invention relates to digging implements and more particularly to implements with driven, auger-type blades that advance sideways into the body of material being dug.

BACKGROUND

The invention has particular application to snowthrowers and consequently will be described in the following with specific reference to that application. It is to be understood that other applications are intended to be included within the scope of this application.

In known snowthrowers, the blades are helical auger flights that intersect axial planes along lines at right angles to the axis. In use, the blade is driven sideways against snow to be removed so that the blade scrapes off snow and advances it towards a discharge, either at the end of the blade casing or in the center, depending on the blade configuration. At the discharge, an extruder throws the snow through a chute that is adjustable to control the distance and direction of throw. Advancing this type of auger blade arrangement against snow requires considerable effort, so that throwers of any significant size are usually propelled by driven wheels or tracks. Similar characteristics are found in digging implements for earth and sand which employ similar auger arrangements.

SUMMARY

The present invention proposes a new blade design that is more efficient and reduces the power requirement for both material removal and propulsion.

According to one aspect of the present invention there is provided a blade for a digging implement of the type having a coiled blade arranged for advancement sideways into a body of the particulate material, said blade comprising a band with a leading edge wound along a blade axis, and a tapered body which slopes towards the axis.

Thus, the blade is set at an angle other than 90° to the axis as seen in an axial plane. This means that the leading edge of the blade slices into the material to be removed rather than scraping across its face.

The novel blade is preferably used in a center discharge arrangement, with two blades oppositely coiled on opposites sides of the discharge. The novel blade has been found to be "aggressive" in that it draws itself forward into the material being removed, so that powered propulsion may be eliminated in many cases, and replaced with skies or wheels.

According to another aspect of the present invention there is provided a snowthrower of the type comprising a casing, a snow discharge from the casing, a blade in the casing, wound along a horizontal blade axis such that rotation of the blade in one direction will advance snow along the casing to the snow discharge, said blade being arranged in the casing with one side exposed for advancement sideways into a body of snow, and means for rotating the blade in the one direction, wherein the blade comprises a band with a leading edge wound along the blade axis and a tapered body sloping from the leading edge towards the blade axis in a direction away from the snow discharge.

The snowthrower may be a single-stage type or a two-stage, where a secondary extruder receives snow from the main blade and propels it through the snow discharge.

BRIEF DESCRIPTION OF THE DRAWINGS

In the accompanying drawings which illustrate an exemplary embodiment of the present invention.

DETAILED DESCRIPTION

Figure 1:
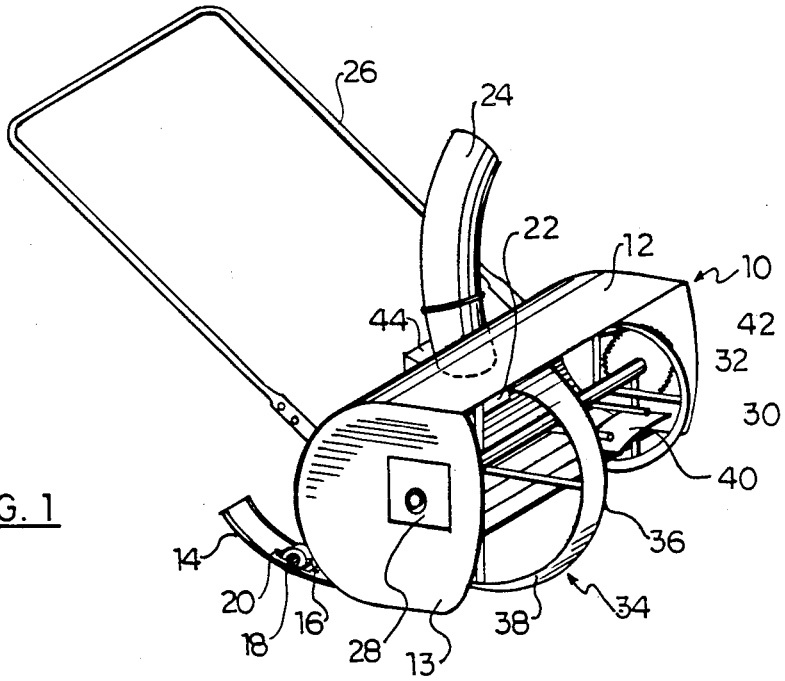
FIG. 1 is a perspective view illustrating a snowthrower incorporating a blade according to this invention.

Referring to the drawings, the illustrated snowthrower 10 has a part cylindrical casing 12 with end panels 13. The casing is supported on a combination of skis 14 and wheels 16. The wheels 16 are mounted in bearings 18 on the skis and project slightly below the skis through slots 20 in the skis.

The casing has a discharge opening 22 at the center between the end walls 13 and leading tangentially upwards into a chute 24 of a conventional type for discharging snow to one side or the other of the snowthrower, depending on the setting of the chute. A handle 26 is mounted on the casing 12 to allow for manual propulsion and steering of the thrower.

Figure 2:
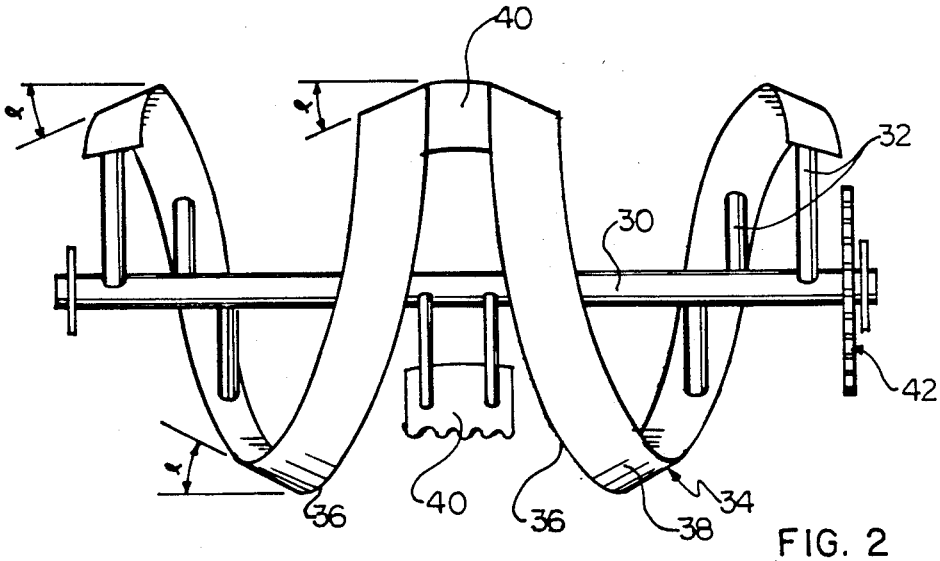
FIG. 2 is a front elevation of the blade.

The end walls 13 of the casing 12 are equipped with bearings 28 that support a shaft 30 extending along the axis of the casing 12. The shaft carries a series of spokes 32 that project radially from the shaft and support, at their outer ends, a snowthrower blade 34. The blade is double-ended. It consists of two steel bands on opposite sides of the discharge 22. Each is helically coiled to extend between the discharge and the adjacent end 13 of the casing 12. Each band has a helically coiled leading edge 36 and a tapered body 38 that slopes towards the shaft 30 in a direction away from the centre discharge 22. One appropriate angle $\alpha$ (FIG. 2) for the slope is 30° to the axis of the shaft 30. Between the blades 34 are four extruder blades or "paddles" 40 that project radially from the shaft 30 to drive snow in the center of the casing 12 around the casing to throw it out of the discharge opening 22 and the chute 24. One of the paddles joins the inner ends of the two blades, and the others are arranged at 90° intervals around the axis. The blade is driven by a chain drive 42 from a motor 44 mounted on the casing 12 below the chute 24.

Figure 3:
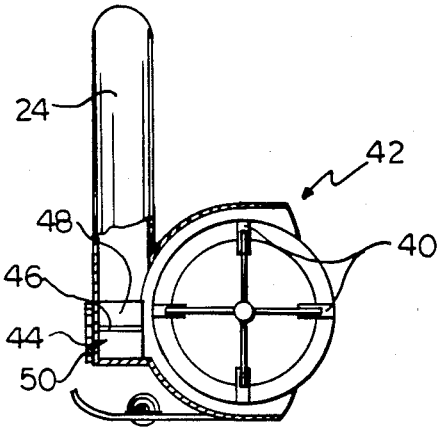
FIG. 3 is a side elevation, in section, of a two-stage snowthrower incorporating a blade according to the invention.

FIG. 3 illustrates a two-stage snowthrower 42, in cross section. The thrower includes an extruder 44 at the center of the casing 12, below the chute 24. This is a shaft 46 carrying radial paddles 48 that sweep a discharge chamber into which snow is fed by the paddles 40 and propel the snow out of the chute 24. The shaft 46 is driven by the motor 44. With the two-stage unit, the center paddles may not be required. The two blade sections meet and form a pocket feeding snow to the second stage extruder.

Figure 4:
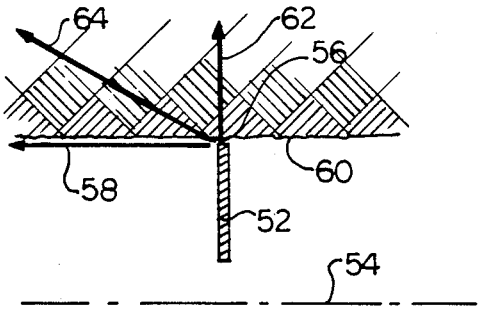
FIGS. 4 and 5 are schematic representations of the operation of the prior art blade and a blade according to the invention.
Figure 5:
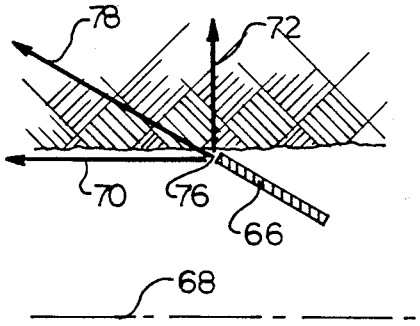

FIG. 4 illustrates the operation of a prior art helical snowthrower blade, wherein the angle between the blade 52 and the blade axis 54 is 90°. The rotation of the blade causes the blade edge 56 to progress in the direction of vector 58, parallel to the snow face 60. Advancement of the blade into the snow face 60 is illustrated with the vector 62, the resultant movement of the blade edge 56 being shown by vector 64. As will be observed, there is a very large angle between the vector 64 and the blade body 52. Referring to FIG. 5, the blade body 66 is shown at an angle of 30° to the blade axis 68. With a rotation vector 70 and forward movement vector 72 similar to the vectors 58 and 62, the resultant movement of the blade edge 76 is in the direction of vector 78 which is substantially parallel to the blade body 66. This will, of course, vary with variations in the speed of advancement, but it will be apparent that the action of the blade 66 is much more closely a slicing action shearing the snow face 60 than a scraping action as is performed with the prior art blade 52 illustrated in FIG. 4.

The foregoing description of two specific embodiments of the present invention is intended for illustrative purposes only and not as limiting the scope of the present invention. The invention is intended to be limited solely by the scope of the appended claims.

I claim:

1. A blade for a digging implement of the type having a shaft, a coiled band wound around the shaft with a space between the shaft and the band and spokes joining the band to the shaft, the blade being arranged for advancement sideways into a body of particulate material, said band having a leading edge wound along a blade axis, and a tapered body with a linear cross section in planes containing the axis and which slopes towards the axis.

2. A blade according to claim 1 wherein the leading edge is wound in a helix.

3. A blade according to claim 1 wherein the blade comprises two sections, wound about the blade axis in opposite directions on opposite sides of a common center.

4. A blade according to claim 3 wherein each blade section slopes towards the axis in a direction away from the other blade section.

5. A blade according to claim 4 comprising extruder means at the common center for ejecting particulate material from the blade.

6. A blade according to claim 5 wherein the extruder means comprise a plurality of paddles rotating with the blade.

7. A blade according to claim 1 wherein the tapered body of the blade slopes towards the axis at an angle of substantially 30°.

8. A blade according to claim 2 wherein the tapered body of the blade slopes towards the axis at an angle of substantially 30°.

9. A blade according to claim 3 wherein the tapered body of the blade slopes towards the axis at an angle of substantially 30°.

10. A snowthrower of the type comprising a casing, a snow discharge from the casing, a blade in the casing, including a shaft extending along a horizontal blade axis , a blade body wound along the blade axis at a spacing from the shaft and spokes joining the blade body to the shaft, the body being wound such that rotation of the blade in one direction will advance snow along the casing to the snow discharge, said blade being arranged in the casing with one side exposed for advancement sideways into a body of snow, and means for rotating the blade in the one direction, wherein the blade body comprises a band with a leading edge wound along the blade axis and a tapered body with a linear cross section in planes containing the blade axis and sloping from the leading edge towards the blade axis in a direction away from the snow discharge.

11. A snowthrower according to claim 10 wherein the leading edge of the blade is wound in a helix.

12. A snowthrower according to claim 10 wherein the snow discharge is located between the ends of the blade and the blade has two sections, wound about the blade axis in opposite directions.

13. A snowthrower according to claim 12 wherein the body of the blades slopes towards the blade axis in a direction away from the snow discharge.

14. A snowthrower according to claim 12 including extruding means between the blade sections for extruding snow through the discharge.

15. A snowthrower according to claim 14 wherein the extruding means includes paddles arranged around the blade axis and rotating with the blade.

16. A snowthrower according to claim 15 wherein the extruding means further comprise a second stage extruder receiving snow from the blade and delivering the snow through the snow discharge.

17. A snowthrower according to claim 10 wherein the body of the blade slopes toward the blade axis at an angle of substantially 30°.

18. A snowthrower according to claim 11 wherein the body of the blade slopes toward the blade axis at an angle of substantially 30°.

19. A snowthrower according to claim 12 wherein the body of the blade slopes toward the blade axis at an angle of substantially 30°.

* * * * *